US006109088A

United States Patent [19]

Schrader et al.

[11] Patent Number: 6,109,088

[45] Date of Patent: Aug. 29, 2000

[54] COOPERATING DIE FOR CRIMPING TOOL HAVING A ROTATABLE DIE WHEEL

[75] Inventors: Gary E. Schrader; Armand T. Montminy, both of Manchester, N.H.

[73] Assignee: FCI USA, Inc., Etters, Pa.

[21] Appl. No.: 09/311,814

[22] Filed: May 13, 1999

[51] Int. Cl.[7] ..... H01R 43/042

[52] U.S. Cl. ..... 72/409.16; 72/409.01; 29/751

[58] Field of Search ..... 72/409.16, 409.1, 72/409.01; 29/751; 81/423

[56] References Cited

U.S. PATENT DOCUMENTS

| | | | |
|---|---|---|---|
| 2,762,414 | 9/1956 | Demler | 153/1 |
| 2,814,222 | 11/1957 | Sanders | 81/423 |
| 3,212,317 | 10/1965 | Lynch | 81/423 |
| 3,903,725 | 9/1975 | Rommel | 81/423 |
| 4,474,046 | 10/1984 | Cook | 72/409 |
| 4,926,685 | 5/1990 | Shannon, Sr. | 72/410 |
| 5,012,666 | 5/1991 | Chen | 29/751 |
| 5,063,770 | 11/1991 | Chen | 72/410 |
| 5,211,050 | 5/1993 | Gouveia et al. | 72/410 |
| 5,277,051 | 1/1994 | Liu | 29/751 |

FOREIGN PATENT DOCUMENTS

| | | | |
|---|---|---|---|
| 3605557 A1 | 8/1987 | Germany . | |
| 657559 | 9/1986 | Switzerland | 72/409.16 |

OTHER PUBLICATIONS

Comfort Crimp™, Thomas & Betts, Installing Instructions Sheet, 3 pages.

*Primary Examiner*—Daniel C. Crane
*Attorney, Agent, or Firm*—Perman & Green, LLP

[57] ABSTRACT

A crimping tool comprising a frame, a die wheel rotatably connected to the frame by a pivot pin, a positioning system for detent locating the die wheel at predetermined rotational positions on the frame, and a cooperating die stationarily connected to the frame. The cooperating die has projections on its lateral sides which form downward and rearward facing support surfaces that rest against edges of the frame.

20 Claims, 5 Drawing Sheets

COOPERATING DIE FOR CRIMPING TOOL HAVING A ROTATABLE DIE WHEEL

BACKGROUND OF THE INVENTION

1. Field of the Invention

The present invention relates to tools with a repositional die and, more particularly, to a cooperating die used with the repositional die.

2. Prior Art

U.S. Pat. No. 5,211,050 discloses a detent mechanism for controlling the position of a rotatable die. The mechanism has a ball biased by a strap. The strap is mounted to the frame between a pivot pin and another pin. U.S. Pat. No. 4,926,685 discloses a repositionable die on a longitudinally movable axle. The axle is biased by a coil spring.

SUMMARY OF THE INVENTION

In accordance with one embodiment of the present invention, a crimping tool is provided comprising a frame, a die wheel rotatably connected to the frame by a pivot pin, and a positioning system for detent locating the die wheel at predetermined rotational positions on the frame. The crimping tool further comprises a cooperating die mounted to the frame opposite the die wheel. The cooperating die comprises a bottom section with a mounting hole, a top section with a crimping surface, and a first laterally extending support surface. The support surface extends from a first lateral side of the cooperating die and rests against an edge of the frame.

In accordance with another embodiment of the present invention a crimping tool is provided comprising a frame, a die wheel rotatably connected to the frame by a pivot pin, and a positioning system for detent locating the die wheel at predetermined rotational positions on the frame. The crimping tool further comprises a cooperating die stationarily mounted to the frame opposite the die wheel. The cooperating die comprises a bottom mounting section, a top section with a crimping surface, and a first lateral projection. The first lateral projection extends from a first lateral side of the cooperating die. The first projection has a first downward facing support surface which rests against an edge of the frame facing the die wheel.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
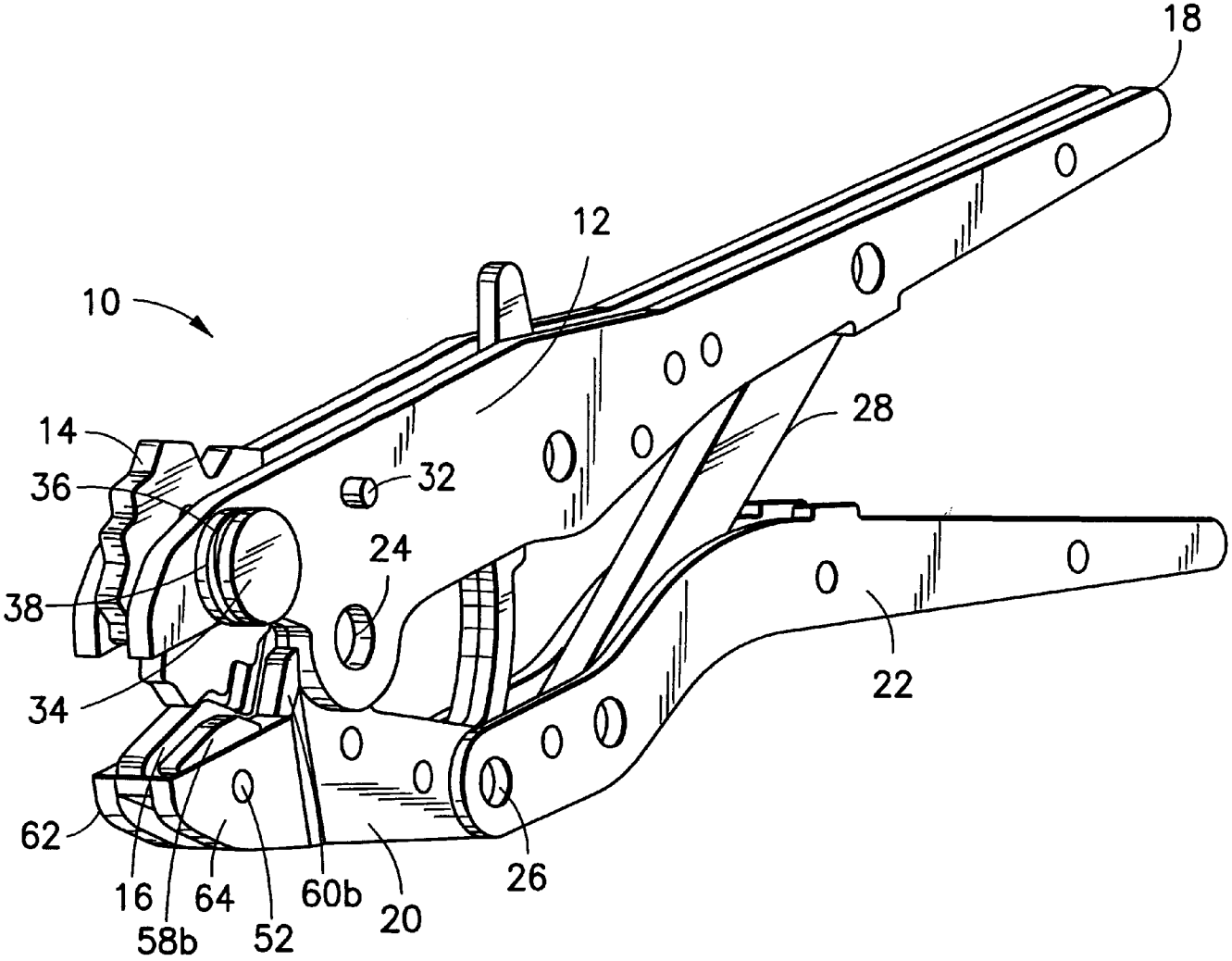
FIG. 1 is a perspective view of a tool incorporating features of the present invention.

Referring to FIG. 1, there is shown an exploded perspective view of a tool 10 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

The tool 10 generally comprises a frame 12, a repositionable die 14 and a stationary die 16. The tool 10 is a manual hand operated crimping tool for crimping connectors onto electrical conductors. However, in alternate embodiments, features of the present invention could be used on other types of tools. The crimping tool 10 is similar to the tool described in U.S. Pat. No. 5,211,050 which is hereby incorporated by reference. The frame 12 includes an upper frame part 18, a lower frame part 20, and a lower handle part 22. The lower frame part 20 is pivotably connected to the upper frame part 18 by a pivot 24. The lower frame part 20 is pivotably connected to the lower handle part 22 by a pivot 26. The lower handle part 22 is connected to the upper frame part 18 by a connecting bar 28. In alternate embodiments other types of frame configurations could be provided.

Figure 2:
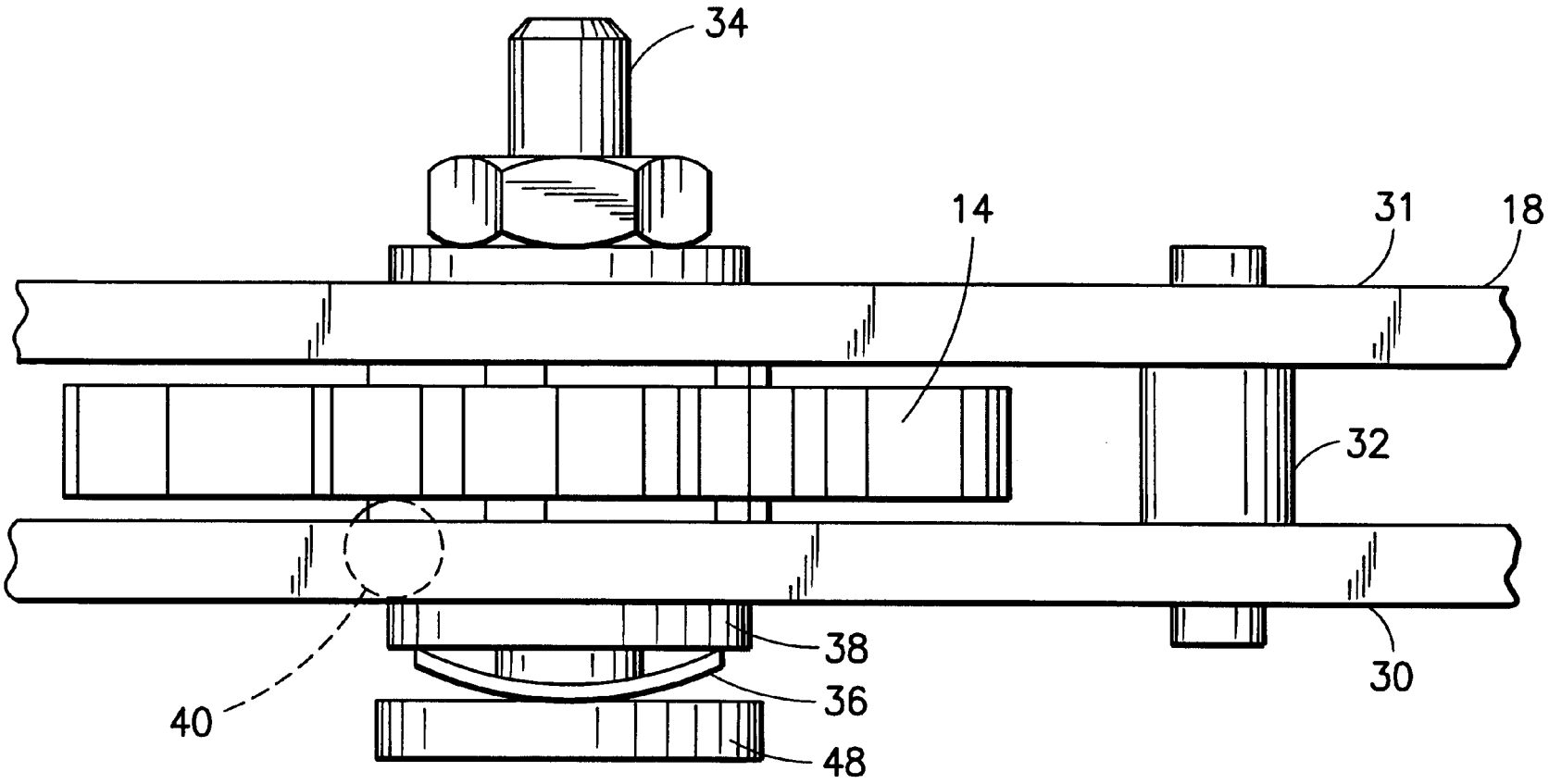
FIG. 2 is a top plan view of a portion of the tool shown in FIG. 1.

The repositionable die 14, in this embodiment, is a die wheel rotatably connected to the upper frame part 18. In alternate embodiments the die 14 could have a shape different from a general rotatable wheel, could be mounted to the upper frame part for sliding and/or rotational movement, or could be mounted to the lower frame part. The die wheel 14 has five different size crimping areas located around its perimeter for crimping five different size connectors. However, any suitable number of different size crimping areas could be provided. Referring also to FIG. 2, the upper frame part 18 includes two frame pieces 30, 31 which are connected and spaced apart by spacers 32. The die wheel 14 is located between the two frame pieces 30, 31. A pivot pin 34 rotatably connects the die wheel 14 to the frame pieces 30, 31.

Figure 3:
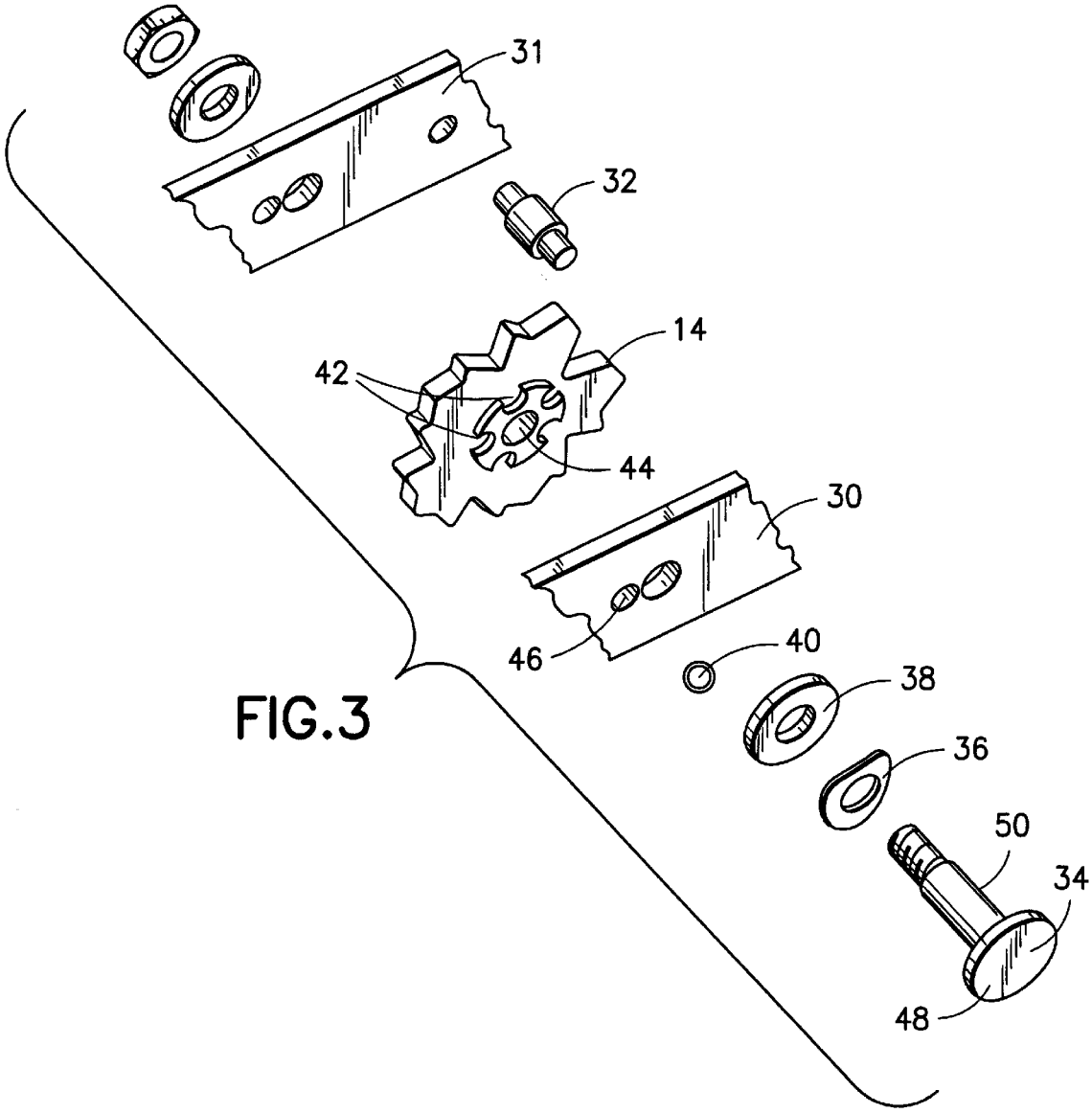
FIG. 3 is an exploded perspective view of the portion of the tool shown in FIG. 2.
Figure 6A:
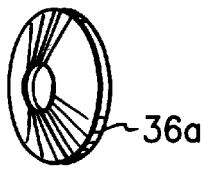
FIG. 6A is a perspective view of an alternate embodiment of the spring for use with the detent system of the tool shown in FIG. 1.
Figure 6B:
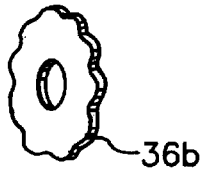
FIG. 6B is a perspective view of another alternate embodiment of the spring.
Figure 6C:
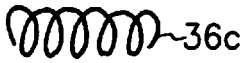
FIG. 6C is a perspective view of another alternate embodiment of the spring.

Referring also to FIG. 3, an exploded view of the portion of the tool shown in FIG. 2 is shown. The tool 10 includes a positioning system for detent locating the die wheel 14 at predetermined rotational positions on the upper frame part 18. The positioning system includes a spring 36, a washer 38 and a ball 40. The die wheel 14 has five seats 42 located on its lateral side surrounding its center mounting hole 44; one seat for each of its perimeter crimping areas. The frame piece 30 has a hole 46 which the ball 40 is located in. The ball 40 contacts the lateral side of the die wheel 14 and the washer 38 on opposite sides of the frame piece 30. In this embodiment the washer 38 is a flat rigid washer. The spring 36 is located between the washer 38 and the head 48 of the pivot pin 34. In this embodiment the spring 36 is a spring washer and, more specifically, a curved washer. However, in alternate embodiments the spring washer could be a Belleville washer 36*a* as shown in FIG. 6A, a wavy washer 36*b* as shown in FIG. 6B, or even a helical wire formed as a spring 36*c* as shown in FIG. 6C. The general ring shape of the spring 36 allows the spring to be mounted on the shaft section 50 of the pivot pin 34. Thus, the spring 36 can be mounted to the frame by only the pivot pin 34.

When assembled, the spring 36 biases the washer 38 towards the frame piece 30 and the ball 40 towards the die wheel 14. When the ball 40 is in registry with one of the seats 42, the ball projects into the seat to detent locate and hold the rotational position of the die wheel 14 relative to the upper frame part 18. When a user manually rotates the die wheel 14 relative to the upper frame part 18, the ball 40 is pushed laterally outward as the ball moves out of the seat 42. The ball 40 pushes the washer 38 outward with the spring 36 being deflected. As another seat 42 comes into registry with the ball 40, the spring 36 pushes the washer 38 laterally inward which, in turn, pushes the ball 40 laterally inward into the new seat to once again detent locate the die wheel relative to the upper frame part 18. Movement of the ball into one of the seats 42 results in a tactile and audible indication for the user that the die wheel is at one of its proper rotational positions for crimping.

Unlike U.S. Pat. No. 4,926,685, the present invention does not require a user to manually depress the pivot pin before the die wheel can be rotated. Unlike U.S. Pat. No. 5,211,050, mounting of the spring only requires the main pivot pin; not an additional mounting pin. In addition, unlike U.S. Pat. No. 5,211,050, because the ball can be positioned closer to the pivot pin, the more compact design allows the die wheel to have a fifth die groove (crimping area) whereas the prior art tool only had four die grooves because of space and size limitations. In addition to the benefits of providing a compact design and allowing the die wheel to have a fifth die groove, the close proximity of the crimping area to the main pivot pin 24 provides the benefit of higher available crimping force on a connector located between the dies 14, 16 or lower handle force during crimping. The closer the dies 14, 16 are located to the main pivot pin 24 the higher the mechanical advantage. This results in an increase of application range as well as a decrease in the handle force required by the user.

Figure 4:
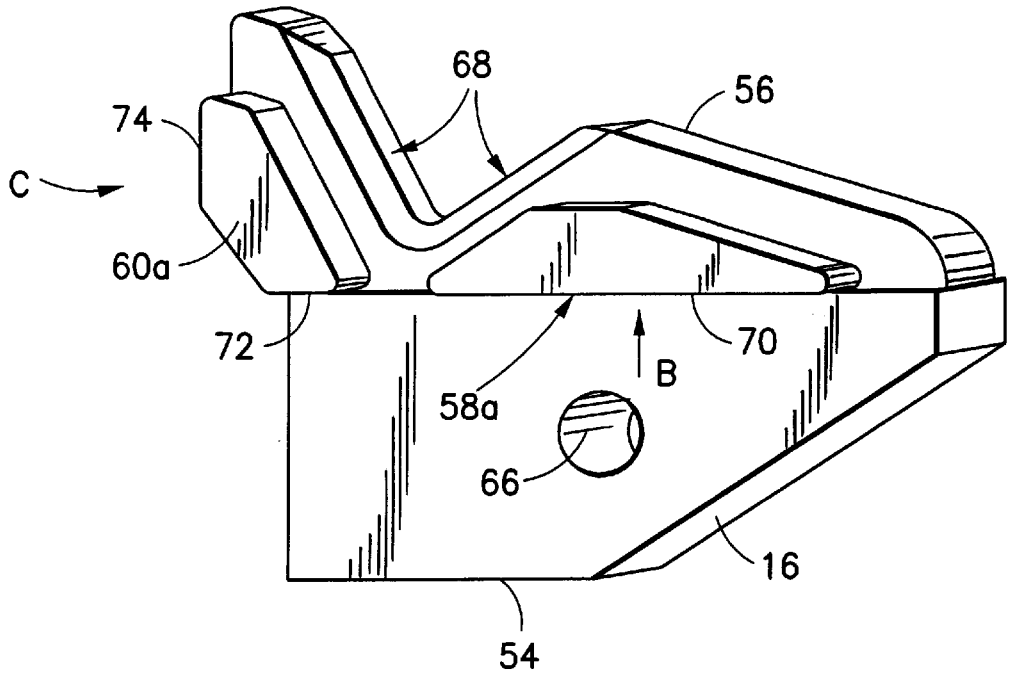
FIG. 4 is a perspective view of the lower die of the tool shown in FIG. 1.

Referring now to FIGS. 1 and 4, a perspective view of the lower die 16 is shown. The lower die 16 is stationarily connected to the lower frame part 20 by a pin 52. The lower die 16 is located generally opposite the die wheel 14 for crimping a connector between the two dies. The lower die 16 generally comprises a bottom section 54, a top section 56, two laterally extending support sections 58*a*, 58*b*, and two laterally extending rear support sections 60*a*, 60*b*. The lower frame part 20 has two sections 62, 64. The bottom section 54 of the lower die 16 is located between the two sections 62, 64. The bottom section 54 has a hole 66 which receives the pin 52. The top section 56 of the lower die 16 has crimping surfaces 68 which contact the connector being crimped. The two laterally extending support sections 58*a*, 58*b* are essentially mirror images of each other, but extend from opposite sides of the die. Each section 58*a*, 58*b* has a bottom surface 70 which rests against the edge of the lower frame part sections 62, 64 which face in the direct towards the die wheel 14 during crimping. These surfaces 70 help to transfer forces incurred during crimping through the die 16 to the lower frame part 20 other than merely through the pin 52. Each rear support section 60*a*, 60*b*, has a lower surface 72 and a rear surface 74. These surfaces 72, 74 also help to transfer forces to the lower frame part 20 that occur during crimping. In alternate embodiments the lower die could have alternative or additional support or force transfer means.

Figure 5:
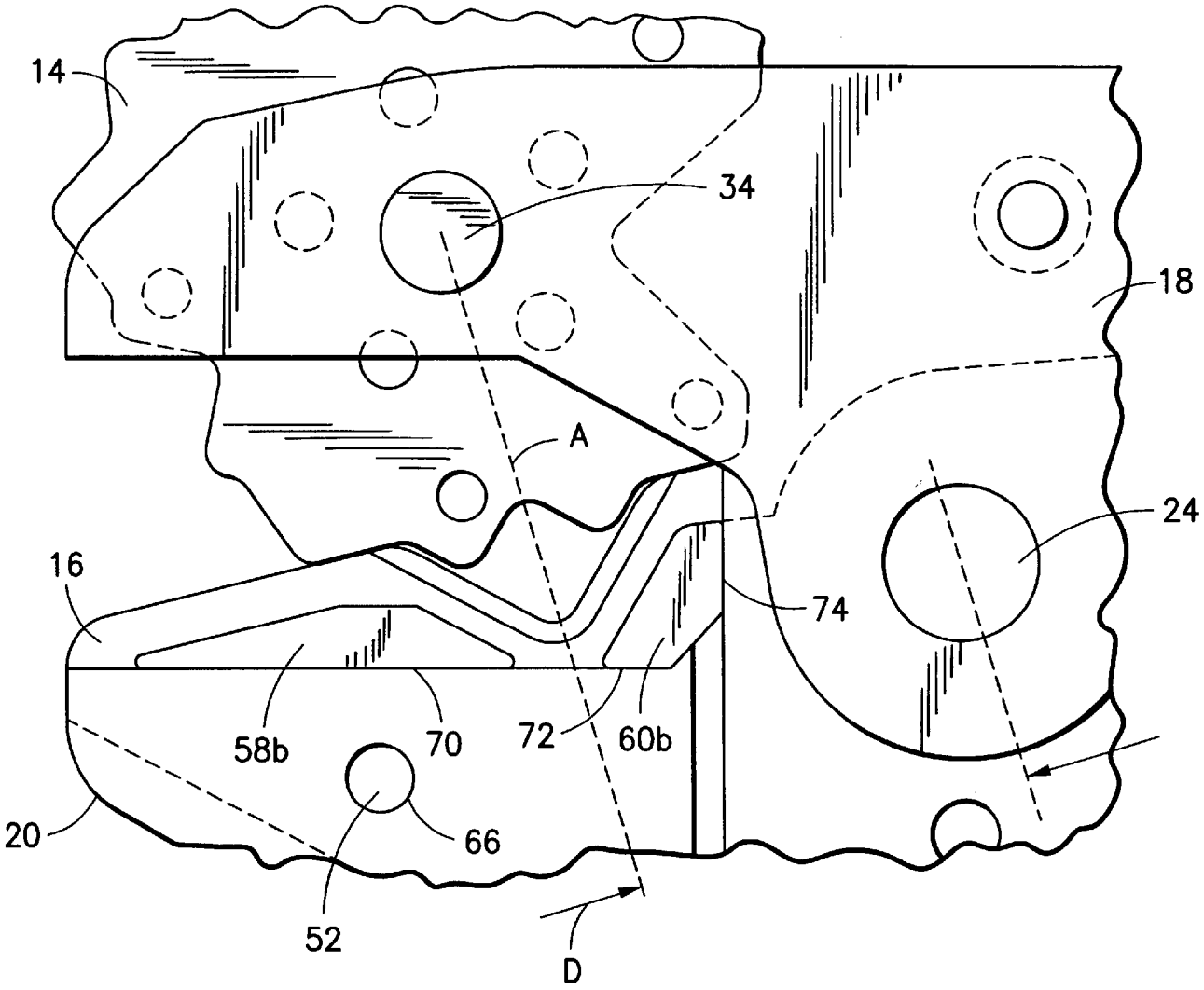
FIG. 5 is a partial elevational side view of a portion of the tool shown in FIG. 1.

Referring also to FIG. 5, the support sections 58*a*, 58*b*, 60*a*, 60*b*, generally increase the strength of the stationary die 16 to withstand crimping forces without breaking. To further decrease the risk of the stationary die breaking the crimp axis A is arranged at an angle. Thus, crimping forces, because of the angled crimp axis A, are divided into forces against surfaces 66, 70, 72 and forces against surfaces 74. This division or distribution of crimping forces reduces stress on the stationary die 16 in the direction B by transferring some force to direction C (see FIG. 4). In addition, the distance D between the main pivot 24 and the pivot pin 34 is reduced to increase the mechanical advantage of the tool's handles to decrease handle force required for crimping and increase the range of connectors that can be crimped with increased force.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In a crimping tool comprising a frame having first and second jaws, and a first die connected to the frame at one of the jaws, wherein the improvement comprises:

a cooperating die mounted to the frame opposite the first die, wherein the cooperating die comprises a bottom section with a mounting hole, a top section with a crimping surface, and two laterally extending support sections extending from a same first lateral side of the cooperating die, wherein a first one of the support sections comprises a first support surface which rests against a first edge of the frame and a second one of the support sections comprises a second support surface which rests against a different second edge of the frame, and wherein the first and second support surfaces are angled relative to each other.

2. A tool as in claim 1 wherein the cooperating die comprises a third laterally extending support section extending from a second opposite lateral side of the cooperating die.

3. A tool as in claim 1 wherein the the second support surface is located at a rear end of the first lateral side of the cooperating die.

4. A tool as in claim 3 wherein the cooperating die comprises a third laterally extending support section located at a rear end of a second lateral side of the cooperating die.

5. A tool as in claim 4 wherein the cooperating die comprises a fourth laterally extending support section extending from the second lateral side.

6. A tool as in claim 1 wherein a top surface of the first laterally extending support section is located below the crimping surface.

7. A tool as in claim 1 wherein the crimping surface has a general V-shaped recess.

8. A tool as in claim 7 wherein the first and second laterally extending support sections are spaced from each other on opposite sides of the general V-shaped recess.

9. A tool as in claim 8 wherein the top sides of the support sections are located below the crimping surface.

10. A tool as in claim 1 wherein the first die comprises a die wheel rotatably connected to the frame by a pivot pin, and the tool further comprises a positioning system for detent locating the die wheel at predetermined rotational positions on the frame, the positioning system having a ball and a spring biasing the ball towards the die wheel, the spring being mounted to the frame by only the pivot pin.

11. A tool as in claim 10 wherein the die wheel comprises at least five different size crimp areas and at least five ball receiving areas, each ball receiving area being located between center axes of two adjacent ones of the crimp areas.

12. A tool as in claim 1 wherein the first die comprises a die wheel rotatably connected to the frame by a pivot pin, and the tool further comprises a positioning system for detent locating the die wheel at predetermined rotational positions on the frame, the positioning system having a ball and a spring biasing the ball towards the die wheel, wherein the ball is located adjacent a rigid flat washer on the pivot pin, and wherein the rigid flat washer is biased by the spring against the ball.

13. A tool as in claim 12 wherein the spring is located between the rigid flat washer and a head of the pivot pin.

14. In a crimping tool comprising a frame with first and second jaws, and a first die connected to the frame, wherein the improvement comprising:

a cooperating die stationarily mounted to the frame opposite the first die, wherein the cooperating die comprises a bottom mounting section, a top section with a crimpring surface, and a lateral projection extending from a lateral side of the cooperating die, the projection having a downward facing support surface which rests against an edge of the frame facing the die wheel and a rearward facing support surface which rests against another edge of the frame.

15. A tool as in claim 14 wherein the bottom mounting section has a hole therethrough with a mounting pin located in the hole mounting the bottom mounting section between two plate sections of the frame.

16. A tool as in claim 14 wherein the cooperating die comprises another lateral projection extending from the first lateral side and having another downward facing support surface which contacts the frame.

17. A tool as in claim 16 wherein the cooperating die has a second lateral side which is a mirror image of the first lateral side.

18. A tool as in claim 16 wherein the crimping surface has a general V-shaped recess and wherein the lateral projections on the first lateral side are located spaced from each other proximate opposite front and rear ends of the general V-shaped recess.

19. A tool as in claim 14 wherein the cooperating die has another lateral projection extending from a second opposite lateral side of the cooperating die having another downwardly facing support surface and another rearward facing support surface.

20. A tool as in claim 18 wherein the V-shaped recess has a center axis which has an inclined angle relative to an axis perpendicular to facing surfaces of the first and second jaws.

* * * * *